US009709299B2

(12) United States Patent
Jansen et al.

(10) Patent No.: US 9,709,299 B2
(45) Date of Patent: Jul. 18, 2017

(54) HEATING BLOCK

(71) Applicant: STIEBEL ELTRON GMBH & CO. KG, Holzminden (DE)

(72) Inventors: Martin Jansen, Holzminden (DE); Wolfgang Heise, Holzminden (DE)

(73) Assignee: STIEBEL ELTRON GMBH & CO. KG, Holzminden (DE)

( * ) Notice: Subject to any disclaimer, the term of this patent is extended or adjusted under 35 U.S.C. 154(b) by 265 days.

(21) Appl. No.: 14/413,184

(22) PCT Filed: Jul. 3, 2013

(86) PCT No.: PCT/EP2013/001949

§ 371 (c)(1),
(2) Date: Jan. 6, 2015

(87) PCT Pub. No.: WO2014/005703

PCT Pub. Date: Jan. 9, 2014

(65) Prior Publication Data

US 2015/0168010 A1 Jun. 18, 2015

(30) Foreign Application Priority Data

Jul. 6, 2012 (DE) ..... 10 2012 013 342

(51) Int. Cl.
*F24H 1/10* (2006.01)
*F24H 9/00* (2006.01)
(Continued)

(52) U.S. Cl.
CPC ..... *F24H 1/102* (2013.01); *F24H 1/103* (2013.01); *F24H 9/0021* (2013.01); *F24H 9/14* (2013.01);
(Continued)

(58) Field of Classification Search
None
See application file for complete search history.

(56) References Cited

U.S. PATENT DOCUMENTS 2,955,184 A * 10/1960 Grindrod ..... H05B 1/0208 165/104.21
4,334,141 A * 6/1982 Roller ..... A47J 31/545 219/505
(Continued)

FOREIGN PATENT DOCUMENTS

AT 410386 4/2003
DE 3817441 11/1989
(Continued)

OTHER PUBLICATIONS

International Search Report for PCT/EP2013/001949, English translation attached to original, Both completed by the Patent Office on Jul. 24, 2014, All together 7 Pages.
(Continued)

*Primary Examiner* — Thor Campbell
(74) *Attorney, Agent, or Firm* — Brooks Kushman P.C.

(57) ABSTRACT

A heating block for use in a water heater for heating water, having a heating block body, in particular made of plastic, for forming a cavity for conducting the water and for receiving at least one heating element. The heating block body includes a first partial shell having a first sub-cavity and a second partial shell having a second sub-cavity. The first and the second partial shells are assembled in a joining region and form between them the cavity from the two sub-cavities. The joining region is not formed, at least partially, in a joining plane and/or the first and the second partial shells are welded together by the supply of heat via a medium, in particular, an essentially abrasion-free and/or vibration-free welding process, and/or the first partial cavity
(Continued)

Figure 1:
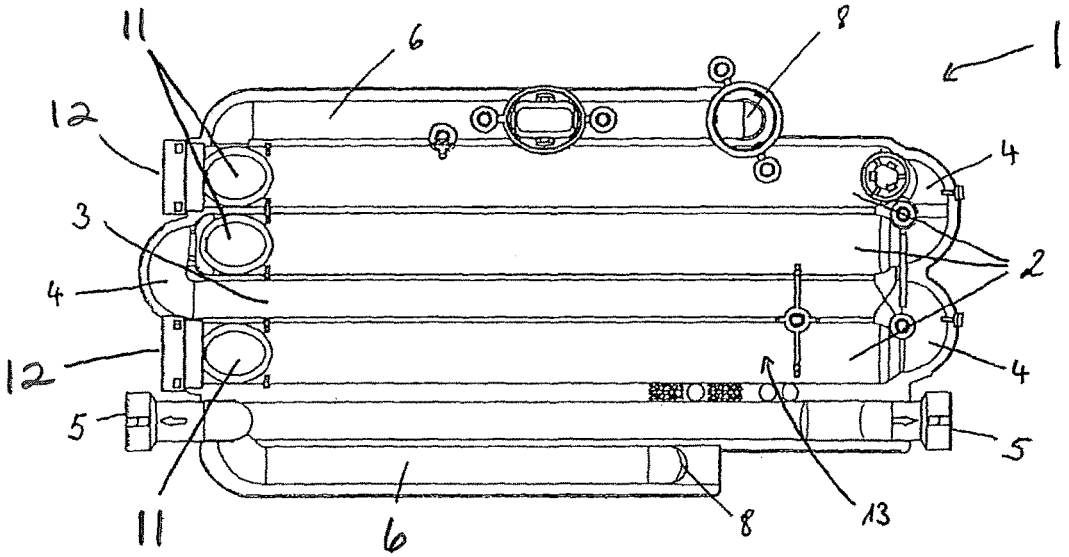

has a greater depth than the second partial cavity or vice versa.

16 Claims, 13 Drawing Sheets

(51) Int. Cl.
*F24H 9/14* (2006.01)
*F28F 21/06* (2006.01)

(52) U.S. Cl.
CPC ..... *F24H 9/146* (2013.01); *F28F 21/066* (2013.01); *F28F 2255/143* (2013.01); *F28F 2275/06* (2013.01)

(56) References Cited

U.S. PATENT DOCUMENTS 4,687,907 A * 8/1987 Barkley ..... B23K 3/047 228/234.1
5,724,478 A * 3/1998 Thweatt ..... F24H 1/142 219/535
6,142,974 A * 11/2000 Kistner ..... A61M 5/44 392/479
6,330,395 B1 * 12/2001 Wu ..... F24H 1/14 392/484
7,046,922 B1 * 5/2006 Sturm ..... F24H 9/2028 392/465
7,088,915 B1 * 8/2006 Sturm ..... F24H 9/2028 392/465
7,177,536 B2 * 2/2007 Natsuhara ..... F24H 1/102 392/473
8,249,437 B2 * 8/2012 Commette ..... F24H 1/102 29/432
8,280,236 B2 * 10/2012 Fabrizio ..... F24H 1/103 392/485
8,744,252 B1 * 6/2014 Snyder ..... F24H 1/142 392/465
2007/0003260 A1 * 1/2007 Thweatt ..... A47L 11/34 392/488
2011/0069943 A1 * 3/2011 Luppold ..... B60H 1/2221 392/488
2014/0046248 A1 * 2/2014 Fini ..... A61M 1/28 604/29
2014/0233928 A1 * 8/2014 Moughton ..... F24H 1/142 392/398
2015/0090802 A1 * 4/2015 Eckert ..... F24H 1/009 237/12

FOREIGN PATENT DOCUMENTS

DE 19632459 2/1998
DE 19651087 6/1998
DE 19651088 6/1998
DE 10063851 7/2002
DE 102009048585 4/2011
DE 102010030099 12/2011
EP 0044040 1/1982
EP 2312224 4/2011
FR 2451143 10/1980
GB 2305233 4/1997

OTHER PUBLICATIONS

Website First page of Wikipedia link dated Dec. 17, 2011 Sent from German Patent Office, Retrieved on Jul. 31, 2015, Original document attached to Machine translation, All together 9 Pages, "Fugen von Kunststoffen" , "Joining of Plastics." https://de.wikipedia.org/wiki/Fügen_von_Kunststoffen.
German Search Report for German Application No. DE 10 2012 013 342.1, Dated Jun. 24, 2013, 5 Pages.

* cited by examiner

A - A

HEATING BLOCK

CROSS-REFERENCE TO RELATED APPLICATION

This application is the U.S. national phase of PCT Application No. PCT/EP2013/001949 filed on Jul. 3, 2013, which claims priority to DE Patent Application No. 10 2012 013 342.1 filed on Jul. 6, 2012, the disclosures of which are incorporated in their entirety by reference herein.

The present invention relates to a heating block for use in a calorifier and to a calorifier for heating a liquid medium and to a partial shell designed for use for producing a heating block.

By means of a calorifier, hot water can be produced in a wide variety of ways. For example, the hot water can be prepared by way of a continuous-flow heater. A continuous-flow heater of said type has a heating block body which is composed of an electrically insulating material and which can accommodate at least one heating element with a conductor through which electrical current passes. A heating block body of said type with an electrical conductor inserted therein will hereinafter be referred to as heating block. Cold water is fed into the heating block at an inlet point, said water flowing out as hot water at an outlet point. The water is heated in throughflow paths or flow paths which are arranged in the heating block and are in the form of duct sections or ducts with diversion points. In this case, for example in a bare wire-type heating system, the current-conducting heating element is situated directly in the water to be heated. Such bare wire-type heating systems exhibit a relatively high flow pressure loss in relation to, for example, tubular heating body-type systems. If the flow pressure decreases to a great extent, this may have the result that only a very small amount of water still flows, or water even stops flowing entirely. Furthermore, such bare wire-type continuous-flow heaters are of large and bulky form owing to a large number of diversions.

The heating block body is normally assembled, by friction welding, from two halves with mutually corresponding contact surfaces or joining surfaces. In the case of friction welding, the two halves are placed onto one another at the contact surfaces and moved relative to one another. In the process, owing to the mechanical friction that is generated in this way, heat is produced which effects a plasticization of the material. The two halves are subsequently joined together under pressure. Owing to the friction, so-called abrasion debris is formed which is not fixedly connected to the weld seam, and thus said abrasion debris can become detached during operation and contaminate the flowing medium. Furthermore, the abrasion debris has an adverse effect on the flow characteristics of the heating block by increasing the pressure loss. Furthermore, in the case of friction welding, the two halves to be placed together must have joining surfaces in a two-dimensional plane in order to be able to be connected to one another.

The two halves of the heating block body are normally produced by means of an injection molding process. In this case, depending on the design of the component to be produced, material accumulations may occur, that is to say regions in which, owing to the form of the component to be produced, the material thickness is greater than in other regions. When the heating block is removed from the injection molds, such material accumulations lead to distortion during cooling. As a result, individual, mutually corresponding parts of the heating block can be placed together only with great outlay; in the event of excessive distortion, this even becomes impossible, and the individual parts are thus unusable. Furthermore, in the case of material accumulations, slower cooling in the interior of the material can result in stresses which can lead to cracks in corners and edges. Furthermore, external sink marks and internal shrinkage holes can form at this location.

The invention is thus based on the object of eliminating or alleviating at least one of the problems mentioned above; in particular, it is sought for the throughflow rate of the water in a calorifier, in particular in a heating block during use of the calorifier, to be kept as constant as possible; in particular, the flow pressure loss is intended to be reduced. Furthermore, it is sought in particular to avoid material accumulations. It is sought at least to propose an alternative solution.

The invention proposes a heating block for use in a calorifier for heating water, as per claim 1. The heating block comprises a heating block body, composed in particular of plastic, for forming a cavity for conducting the water and for accommodating at least one heating element. In this case, the heating block body comprises at least one first partial shell with a first sub-cavity and a second partial shell with a second sub-cavity. The first and the second partial shell are placed together in a joining region and form between them the cavity composed of the two sub-cavities. The joining region is at least partially not formed in a joining plane, and/or the first and the second partial shell are welded to one another by means of a medium through the supply of heat, in particular are welded by means of a substantially abrasion-free and/or vibration-free welding process, and/or the first sub-cavity advantageously has a greater depth than the second sub-cavity or vice versa.

The cavity is designed such that it can accommodate water that is conducted through it. In this case, cold water is supplied to the cavity, is heated as it flows through by the heating elements arranged in the cavity, and emerges from the cavity, for further use, having been heated.

In this case, a cavity is understood to mean a hollow chamber, in particular in the form of duct sections and/or ducts. Said duct sections and/or ducts are in particular designed, and/or connected to one another by diversion points, such that the water to be heated can flow through them in meandering fashion. To form such a cavity or such a duct section and/or duct, the first and the second partial shell are placed together in a joining region. In this case, the first and the second partial shell have a first and a second contact surface respectively, which is synonymous with a first and a second joining surface. The joining surface is not restricted to a two-dimensional joining plane. It may have a first section in a joining plane in the two-dimensional sense, and another, second section outside said two-dimensional joining plane. Thus, it is the case for example in the second section that the joining surface departs from the two-dimensional joining plane by being curved, by being angled with respect to said plane in the second section, by running parallel to the plane of the first section in the second or in a further section, and/or by virtue of the joining surface having an overall form which cannot be represented in a two-dimensional plane. In this case, the joining surface may be of meandering form and run partly in the two-dimensional joining plane. As a result, duct sections can rise and fall, whereby at least two of the water-conducting duct sections or ducts can be arranged one above the other. The joining surface can thus be configured substantially freely, without restriction to a two-dimensional plane. This is also conducive to the joining surface being designed such that, during the joining process, material accumulations are avoided and/or undershooting of the minimum material thickness between two duct sections or ducts is prevented.

The first and the second partial shell are preferably welded by means of media through the supply of heat. Such a medium is in particular air or another gas. Furthermore, use may also be made of a laser beam, plasma beam or other energy beam. The heat is thus transported to the regions to be welded, specifically in particular to the joining surfaces. The heat is thus not generated at the joining surfaces by the conversion of kinetic energy into heat energy. In particular, friction welding is not used. By means of an abrasion-free and/or vibration-free welding process, therefore, no abrasion debris is produced which can remain in the partial shells or cavities and thus potentially cause problems. Such abrasion debris is produced in particular during friction welding. Friction welding should thus not be used. As a medium, use is made in particular of a protective gas such as, for example, nitrogen or another inert gas which has the effect that, during the plasticization of the joining region, oxidization of the melt is virtually prevented. By means of such a welding process, it is possible to connect together partial shells which have joining surface sections situated outside the two-dimensional joining plane. Such a welding process is understood for example to mean laser welding or hot-gas welding.

The first sub-cavity preferably has a greater depth than the second sub-cavity or vice versa. The depths of the sub-cavities are thus not equal. For example, the first sub-cavity substantially forms the duct section and/or duct through which the water flows, and the second sub-cavity forms a type of cover which covers the first sub-cavity. A uniform wall thickness can thus be attained. In an embodiment in which both sub-cavities have approximately the same depth, there is normally a greater wall thickness in the regions in which the two sub-cavities are placed together. This can be avoided through the use of different depths.

The first and the second partial shell are preferably each provided as plastics injection-molded parts, and can be produced with correspondingly high precision. The partial shells each have corresponding contact surfaces or joining surfaces in order to be welded by means of a medium through the supply of heat. As a result of the combination of injection-molded parts and the use of welding, an adaptation of the partial shells to a variety of forms is possible.

In a preferred embodiment, a third partial shell is provided which is placed together with the first or second partial shell such that the first or second and the third partial shell form between them an insulation duct for forming an insulation path. In this case, the insulation duct is in particular free from heating elements. The insulation duct is in this case arranged as an upstream or downstream segment of the duct sections and/or ducts provided with heating elements, and has a duct section between the inlet point and/or outlet point for the water. Said upstream and downstream segments and the duct sections and/or ducts with heating elements are arranged in the heating block, wherein the upstream and downstream segments form an electrical resistance for insulation between the inlet point or outlet point and the heating element.

Preferably, the cavity forms a heating duct for accommodating at least one heating element and the heating duct is arranged between the first and the second partial shell in a first duct plane of extent, and the insulation duct is arranged between the second and the third partial shell in a second duct plane of extent, in particular such that the first, second and third partial shells form a sandwich structure. Below, a duct plane of extent is to be understood to mean a plane in which the respective duct sections or ducts are substantially arranged. The various duct planes of extent are arranged one above the other, such that the duct sections or ducts can be situated partially one above the other and cross one another. Thus, for example, provision of the insulation ducts together with the heating ducts in the first duct plane of extent is not necessary. Instead of arranging the insulation ducts adjacent to one another in the first duct plane of extent, they are provided substantially in the second duct plane of extent. Thus, a compact design of the heating block is possible in which the duct sections or ducts in the different duct planes of extent are situated one above the other and are easily accessible from the side. Thus, a control unit or other elements can for example be coupled directly to the heating block.

In a further embodiment, the heating duct has meandering duct sections, and/or the insulation duct has straight duct sections, which are connected to one another approximately at right angles. Through the use of duct sections which are connected to one another at right angles, a 180° diversion can be divided into two 90° diversions with a transverse duct section additionally arranged in between. The duct length is thus increased by the length of said at least one transverse duct section. The number of changes in flow direction is thus reduced by up to approximately 40%, or the heating block has fewer 180° diversions while having the same flow length and the same available surface area, whereby the flow pressure loss can be reduced.

In a preferred embodiment, the first and the second partial shell and optionally a or the third partial shell are placed together and fixedly connected to one another by means of hot-gas welding. In this case, the first and the second partial shell and optionally the third partial shell are plasticized by hot gas and subsequently placed together. The gas flows contactlessly directly into the joining region. Through the use of protective gas, for example nitrogen, oxidation of the melt is virtually prevented during the plasticization. Owing to the connection by hot-gas welding, the partial shells are designed for being connected at a three-dimensional joining surface or contour. As a result of the partial shells being placed together by means of hot-gas welding, a connection is formed which has high load capacity, in particular higher load capacity than a connection produced by means of friction welding.

The welding may be performed for example by virtue of a heating tool being used to supply hot gas to the two joining surfaces that are to be connected to form one joining surface. The heating tool may in this case be approximately matched to the shape of the respective joining surface. Thus, in one heating step, the two partial shells to be connected are brought together in the region of the joining surface with a spacing which is large enough that the heating tool can still be arranged there between the two partial shells in order to heat the partial shells with the hot gas. When the joining surfaces have been adequately heated, the heating tool is removed and the two partial shells are pressed against one another, wherein the two partial shells connect to one another in the region of the heated joining surfaces, and are fixedly connected after cooling again.

Preferably, at least one insulation duct has an inlet point for the supply of the water and an outlet point for the discharge of the water, and/or the inlet point and outlet point are/is fixedly connected to one of the partial shells. In this case, the inlet and/or outlet point is formed for example as a connection piece which has a duct section formed as a type of ramp. By means of the ramp, the duct plane of extent of the duct section that conducts the heated water is exited via the inlet and/or outlet point. The inlet and/or outlet point can thus be formed entirely in the first or second partial shell. If using hot-gas welding, the ramp can be formed as part of the duct section or duct or fused to the latter.

In a further embodiment, the at least one heating element has a component through which electrical current flows, in particular a heating coil. In this case, the heating coil is situated directly in the water to be heated, and is in particular in the form of a non-insulated bare wire or heating wire. In this way, high efficiency is attained with short reaction and heating times.

In a further embodiment, the cavity has at least one meandering heating duct. In this case, the heating duct has at least one heating section with the heating element for heating the water, and, in the first and in the second partial shell, in each case one first and second duct half of the heating duct is in the form of a first and second meandering channel or groove respectively. In this case, the first meandering groove or channel has a greater depth than the second meandering groove or channel or vice versa.

Below, a duct half is understood to mean one part of two parts which together form a duct, wherein the individual duct halves are in particular each in the form of open channels or grooves which are placed together to form a closed, in particular tubular, preferably circular-section duct. In this case, the two duct halves are in particular different, in particular are not of equal size, with one being deeper than the other. The water flows substantially through the deeper groove or channel. The groove or channel with the smaller depth is designed substantially for closing or covering the duct.

In a preferred embodiment, the meandering heating duct has a wall thickness which is uniform substantially throughout, in particular the heating duct has a wall thickness which is uniform throughout in the circumferential direction thereof. To realize a wall thickness which is uniform throughout, the duct halves are preferably formed so as to be of different thicknesses and different depths. In particular, the thinner duct half has the smaller depth. When the two duct halves are joined together, the thinner duct half covers the duct half with the greater wall thickness, and is thus fused to the latter such that the duct has an approximately uniform wall thickness. Different wall thicknesses are thus avoided in the joining region. The two duct halves, placed together, jointly form the heating duct. The uniform wall thicknesses have the effect in particular of preventing the elements from distorting during or after manufacture.

The meandering heating duct preferably has heating sections which are arranged parallel to one another and which may have opposite flow directions. Between the heating sections arranged parallel to one another, there is preferably arranged at least one intermediate duct for separating the electrical potentials of adjacent electrical heating elements. In this case, the at least one intermediate duct is connected to a heating section at a diversion point, and the intermediate duct in particular does not have a heating element. Each heating section has a respective heating element, in particular a heating coil, in the interior of the duct sections. A heating system designed in this way substantially has low compensation currents even at the points of direct contact with the water at the water inlet point and outlet point.

In a further embodiment, the intermediate duct has a smaller duct circumference and/or a smaller duct internal diameter than one or all of the diversion points.

In a preferred embodiment, the heating block has water ports for use in the case of over-table and under-table arrangements, wherein it is possible to select or switch between said water ports. The water ports for use in the case of the over-table arrangement are arranged on the bottom, whereas those for the under-table arrangement are arranged on the top, in relation to an intended usage orientation. In this case, the upstream and downstream segments or insulation paths are arranged so as to be designed both for an over-table arrangement and for an under-table arrangement. The water ports can be retroactively opened and closed off again. The heating block can thus be used flexibly in an over-table or under-table arrangement.

Furthermore, according to the invention, there is proposed a calorifier for heating a liquid medium, comprising a heating block according to at least one of the above embodiments. A calorifier is understood here preferably to mean a continuous-flow heater, in particular with a bare wire-type heating system. In the continuous-flow heater, cold water is heated by means of the heating block. Owing to the water being diverted across more than one duct plane of extent in the heating block, the continuous-flow heater is of compact form.

The calorifier preferably has a casing, in particular a housing. The casing comprises a rear wall, a front wall, a first and a second side wall, a cover and a base. In this case, it is preferable for one partial shell, in particular the third partial shell, of the heating block to be formed as a constituent part of the rear wall as described above in certain embodiments.

The contour of the rear wall is in this case designed such that the partial shell can be integrated into the rear wall. A compact design of the calorifier is possible in this way.

In a further embodiment, the calorifier is designed for use in an over-table arrangement and/or under-table arrangement. In this case, the calorifier has appropriate water port means. An under-table arrangement is for example an open hot-water tank, arranged under a worktop or the like, for the washbasin or the sink. An over-table arrangement is for example a closed continuous-flow heater, in particular hot-water tank for providing a supply to multiple extraction points.

Furthermore, according to the invention, there is proposed a partial shell designed for use for producing a heating block according to at least one of the above embodiments. The partial shell comprises a joining surface designed for welding to a further partial shell. In this case, the joining surface is at least partially not arranged in a two-dimensional joining plane. Thus, the joining surface may have a section in a two-dimensional joining plane and a further section outside the two-dimensional joining plane.

The partial shell is preferably designed for use for producing a heating block according to one of the above embodiments. The partial shell comprises two water ports. In this case, one water port forms a water inlet point, and one water port forms a water outlet point, wherein at least one water port is situated at least outside one of the joining planes and is formed out of one of the partial shells, and wherein, in particular, the water inlet point and/or the water outlet point defines a flow direction which is substantially parallel to the joining plane.

The water ports are thus formed in the partial shell and are provided as part of the injection-molded part. In this case, the water ports are formed such that the water flows in and out substantially parallel to but outside the joining plane.

FIG. 1 shows an exemplary embodiment of a first partial shell in a plan view of an outer side.

Figure 1A:
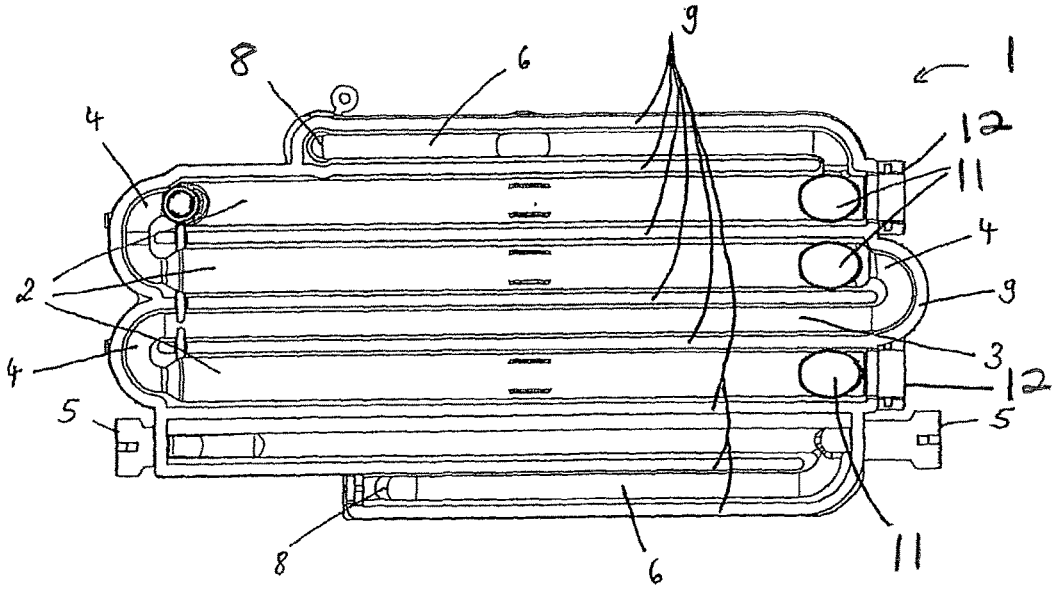

FIG. 1*a* shows the first partial shell from FIG. 1 in a plan view of the joining side for joining to a second partial shell.

Figure 1B:
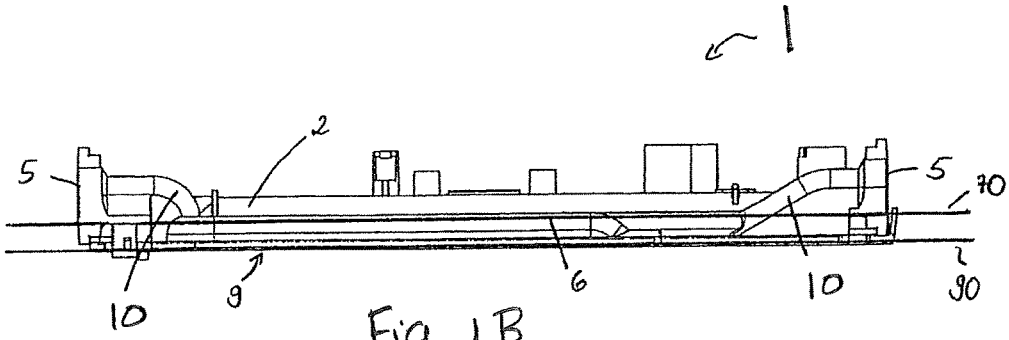

FIG. 1*b* shows the first partial shell from FIG. 1 in a side view.

Figure 1C:
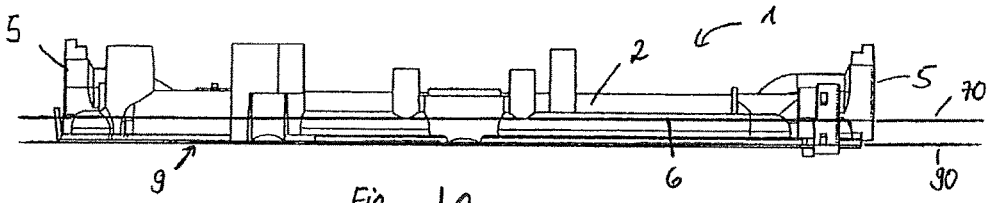

FIG. 1*c* shows the first partial shell from FIG. 1 in a further side view.

Figure 1D:
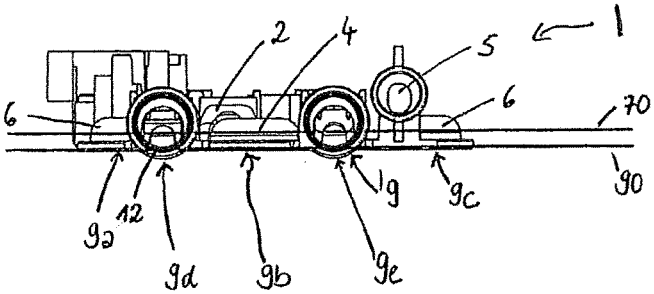

FIG. 1*d* shows the first partial shell from FIG. 1 in a bottom view.

Figure 1E:
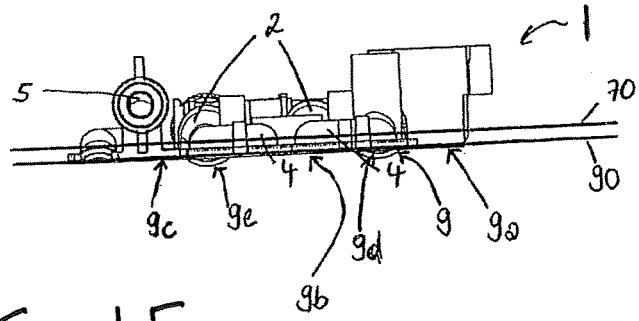

FIG. 1*e* shows the first partial shell from FIG. 1 in a top view.

Figure 2:
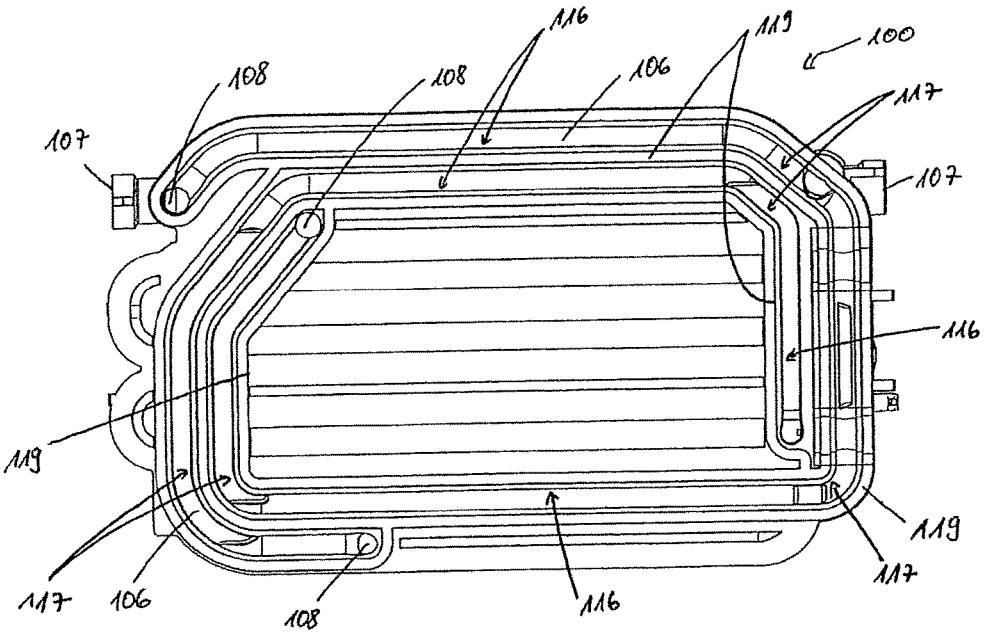

FIG. 2 shows an exemplary embodiment of a second partial shell in a plan view.

Figure 2A:
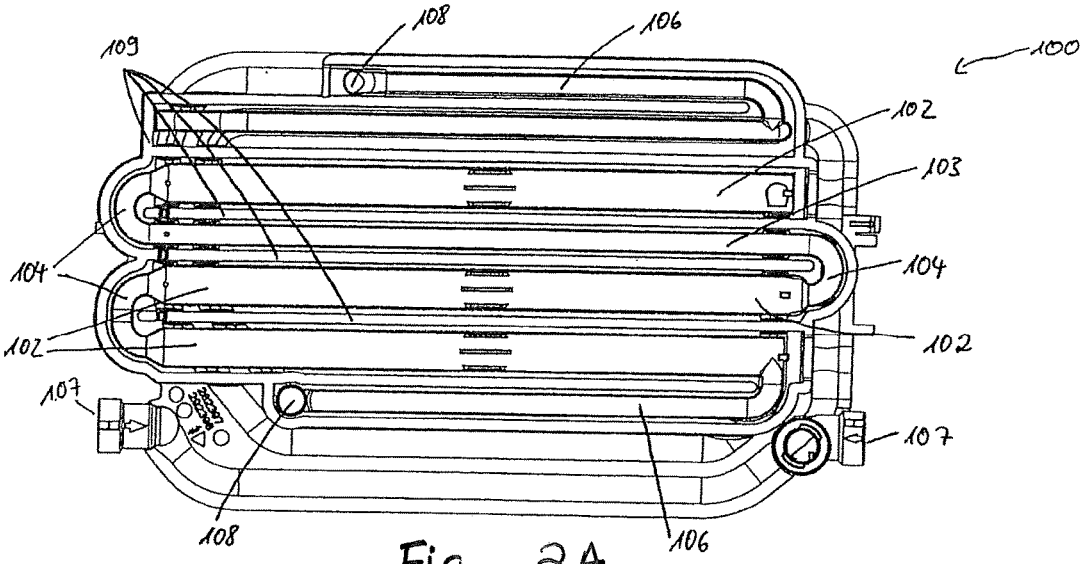

FIG. 2*a* shows the second partial shell from FIG. 2 in a plan view of another side.

Figure 2B:
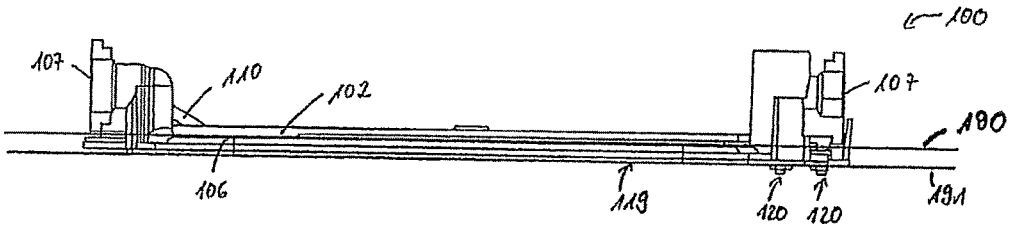

FIG. 2*b* shows the second partial shell from FIG. 2 in a side view.

Figure 2C:
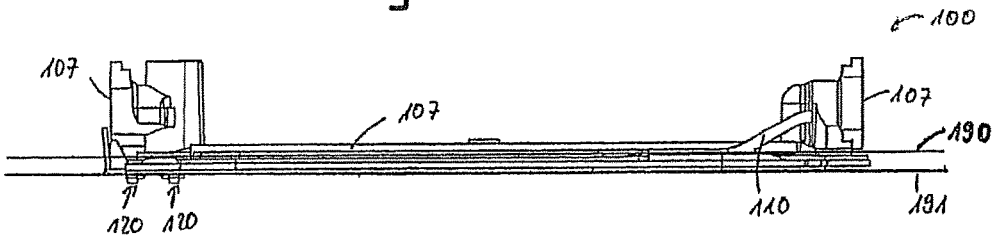

FIG. 2*c* shows the second partial shell from FIG. 2 in a further side view.

Figure 2D:
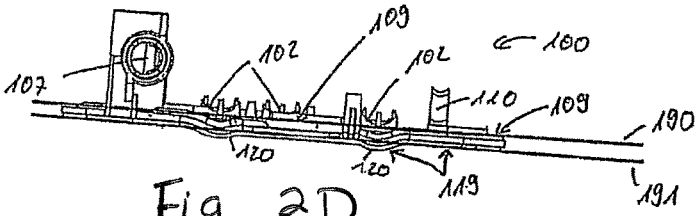

FIG. 2*d* shows the second partial shell from FIG. 2 in a further side view.

Figure 2E:
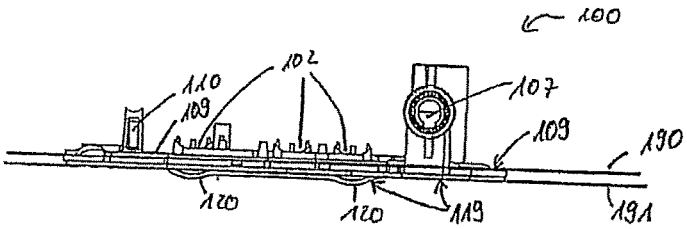

FIG. 2*e* shows the second partial shell from FIG. 2 in a further side view.

Figure 3:
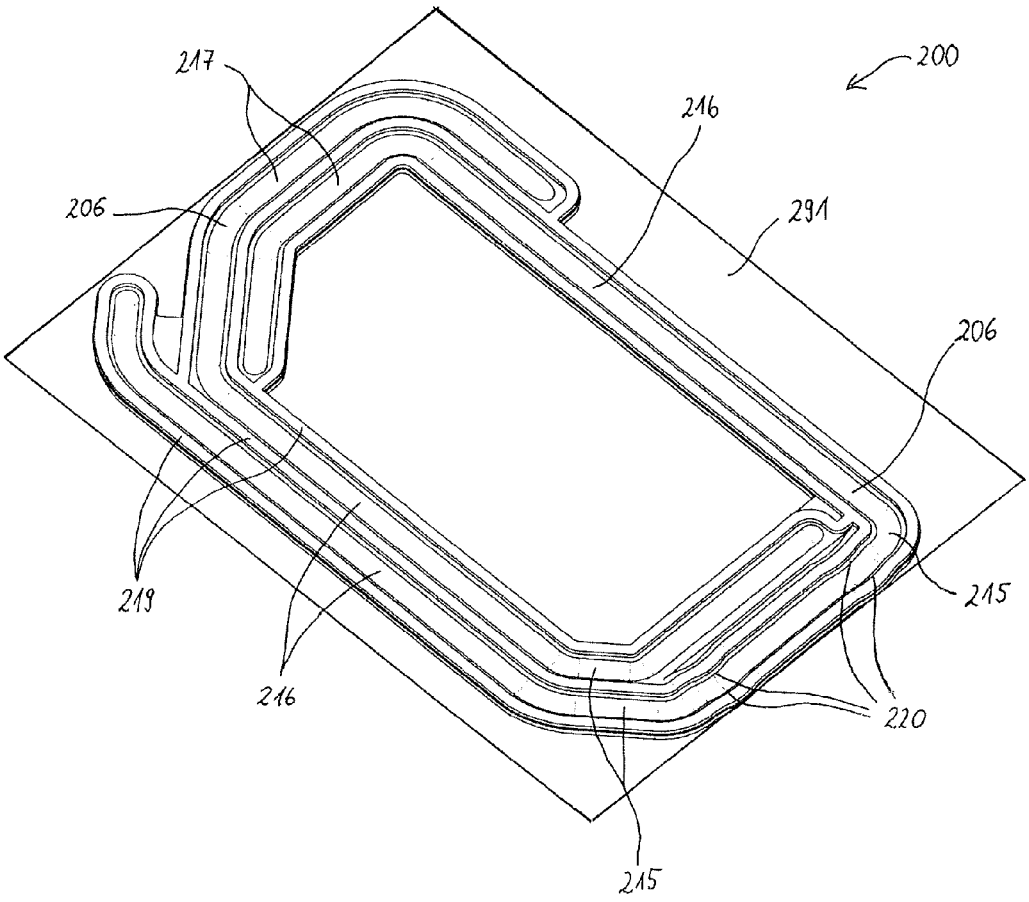

FIG. 3 shows an exemplary embodiment of a third partial shell in a perspective view.

Figure 3A:
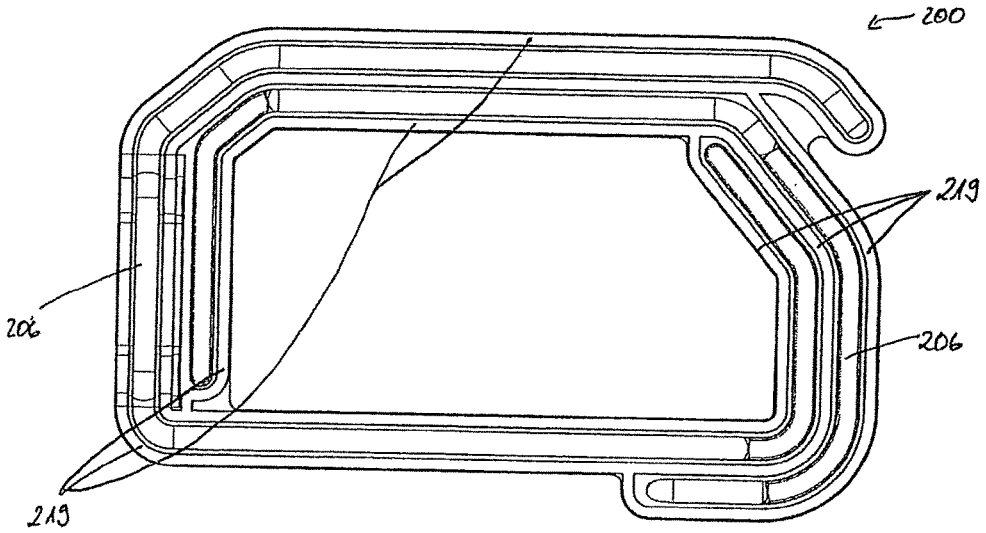

FIG. 3*a* shows the third partial shell from FIG. 3 in a plan view.

Figure 3B:
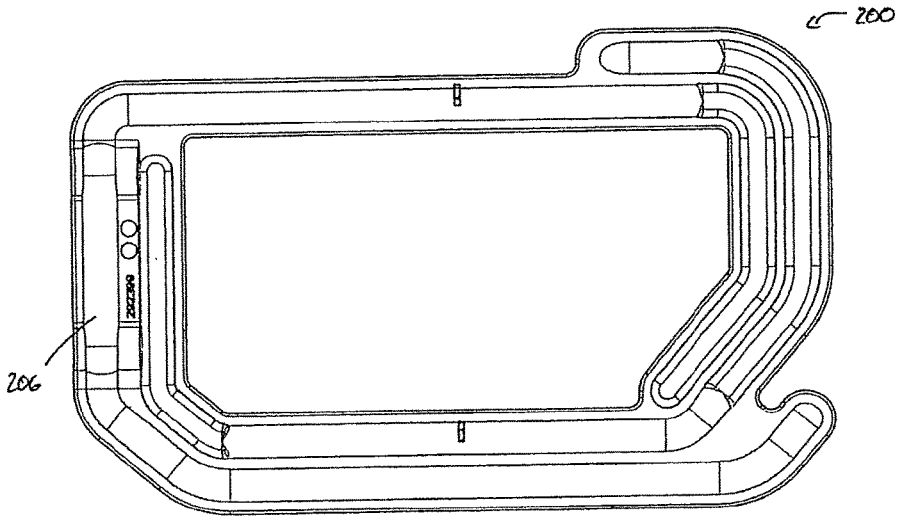

FIG. 3*b* shows the third partial shell from FIG. 3 in a further plan view.

Figure 3C:
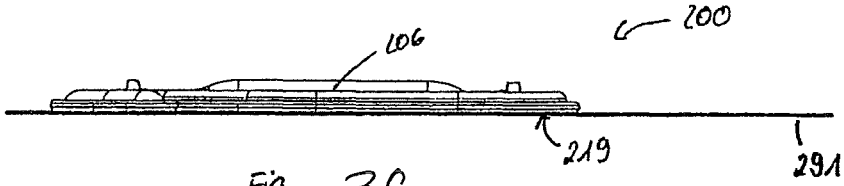

FIG. 3*c* shows the third partial shell from FIG. 3 in a side view.

Figure 3D:
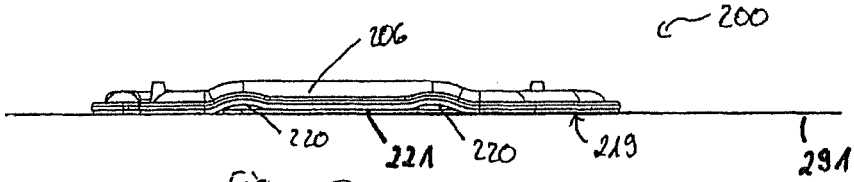

FIG. 3*d* shows the third partial shell from FIG. 3 in a further side view.

Figure 3E:
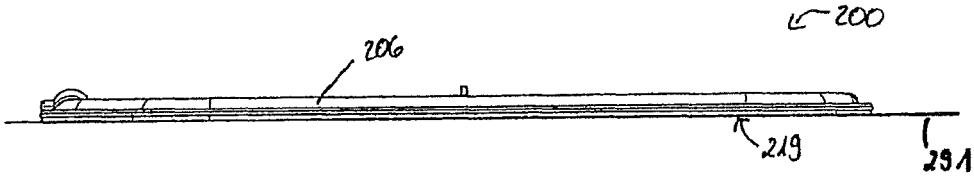

FIG. 3*e* shows the third partial shell from FIG. 3 in a further side view.

Figure 3F:
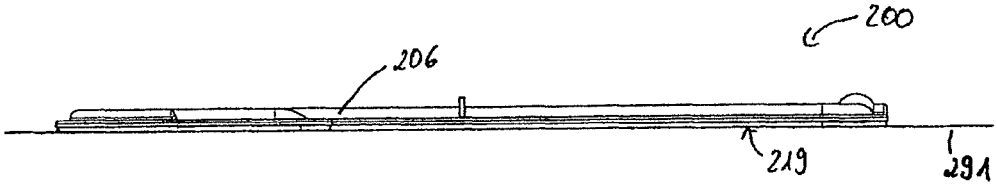

FIG. 3*f* shows the third partial shell from FIG. 3 in a further side view.

Figure 4:
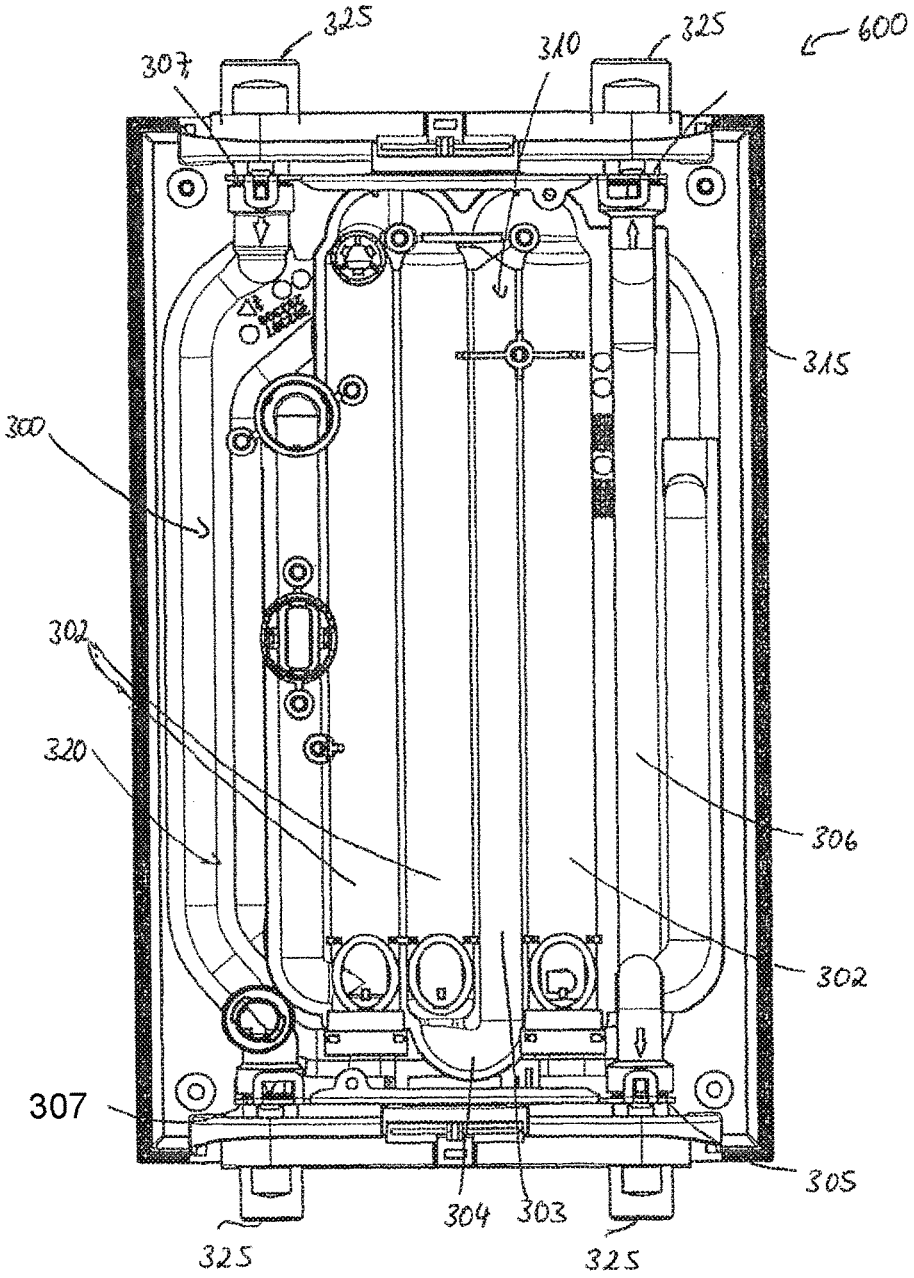

FIG. 4 shows an exemplary embodiment of a continuous-flow heater, without a cover, in a plan view.

Figure 4A:
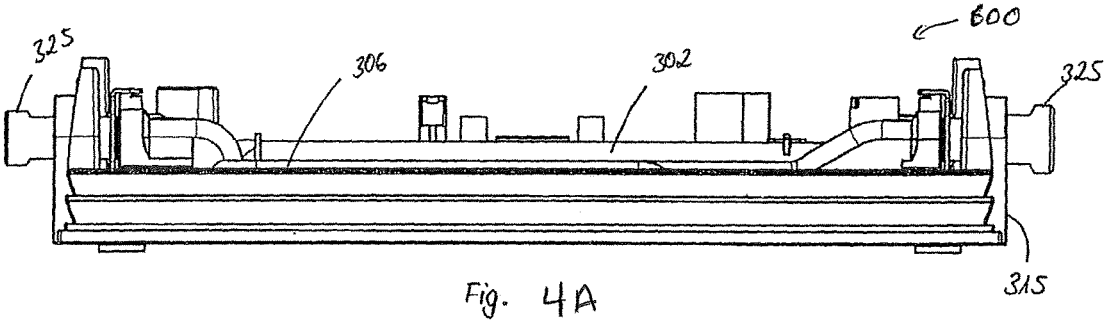

FIG. 4*a* shows the continuous-flow heater from FIG. 4 in a side view.

Figure 4B:
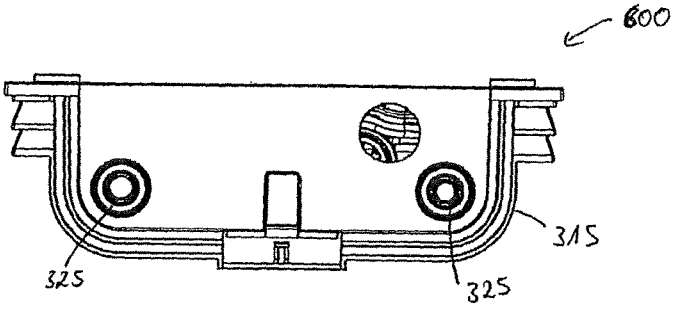

FIG. 4*b* shows the continuous-flow heater from FIG. 4 in a further side view.

Figure 5:
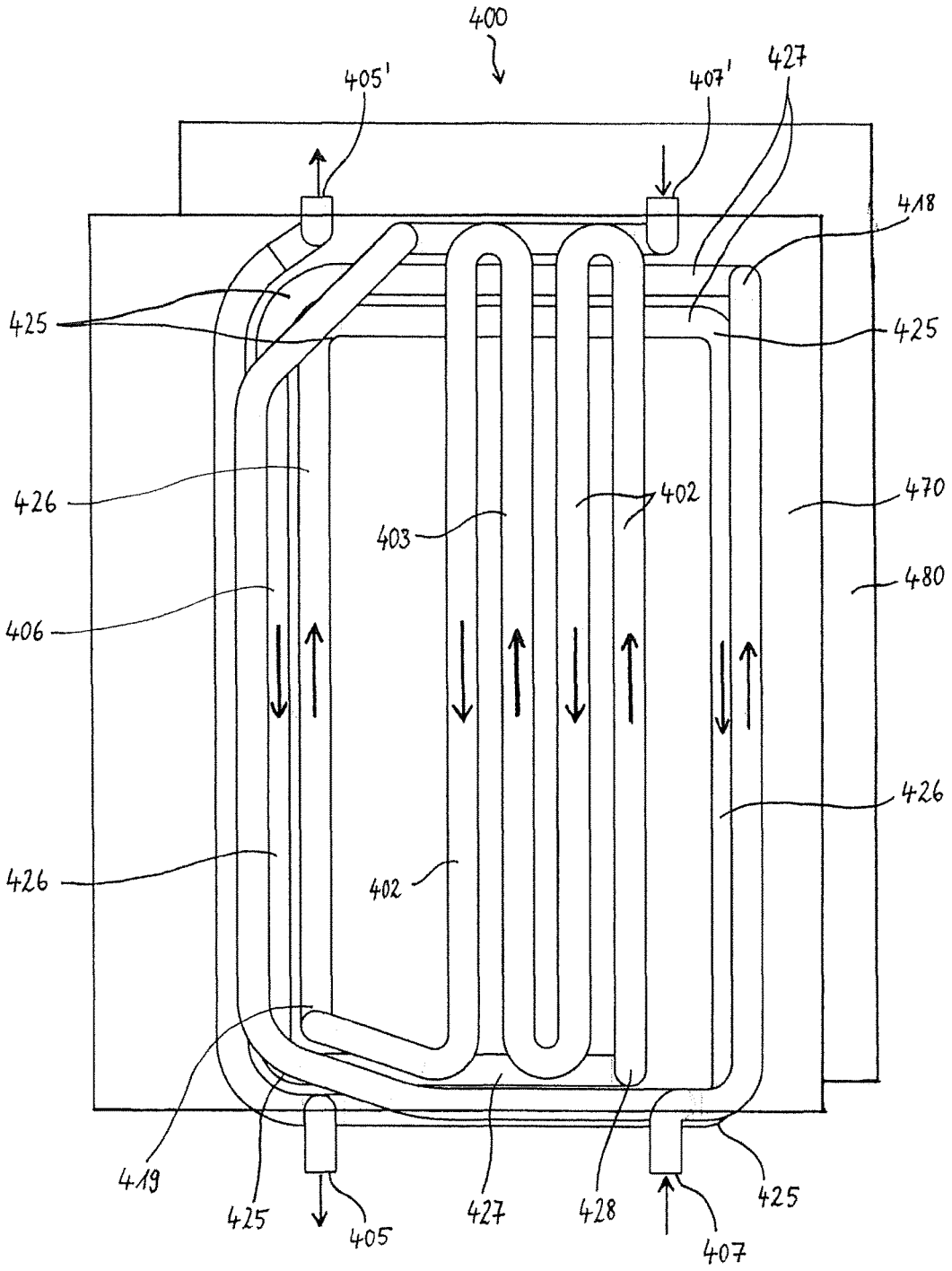

FIG. 5 schematically shows a duct system of a heating block in a plan view.

Figure 5A:
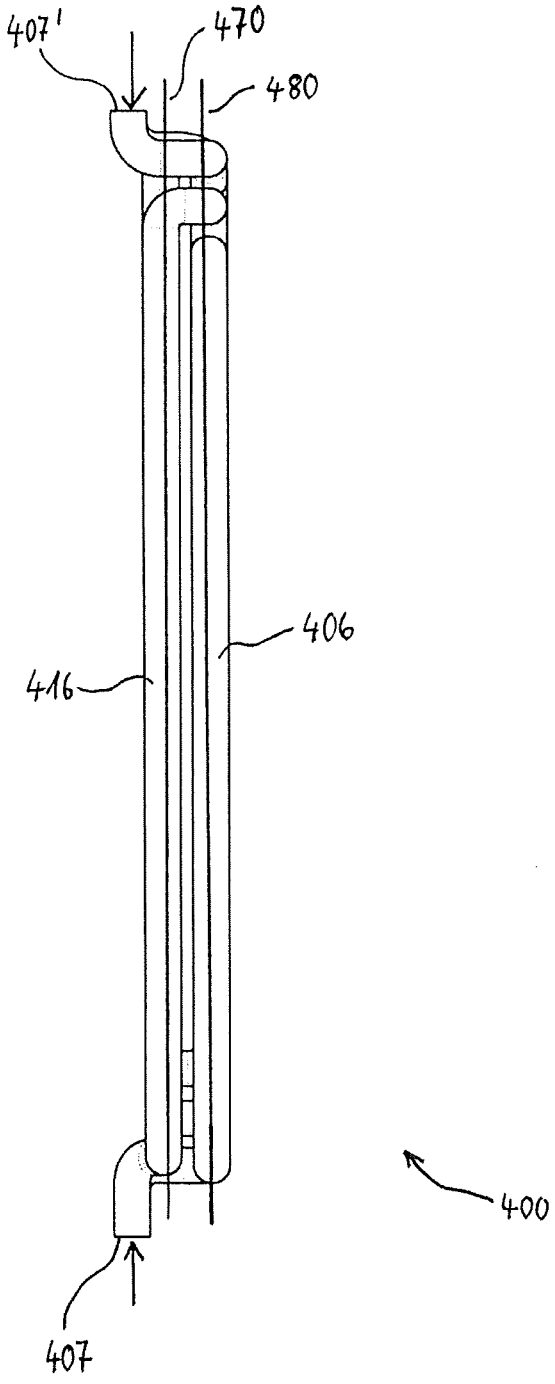

FIG. 5*a* shows the duct system from FIG. 5 in a side view.

Figure 6:
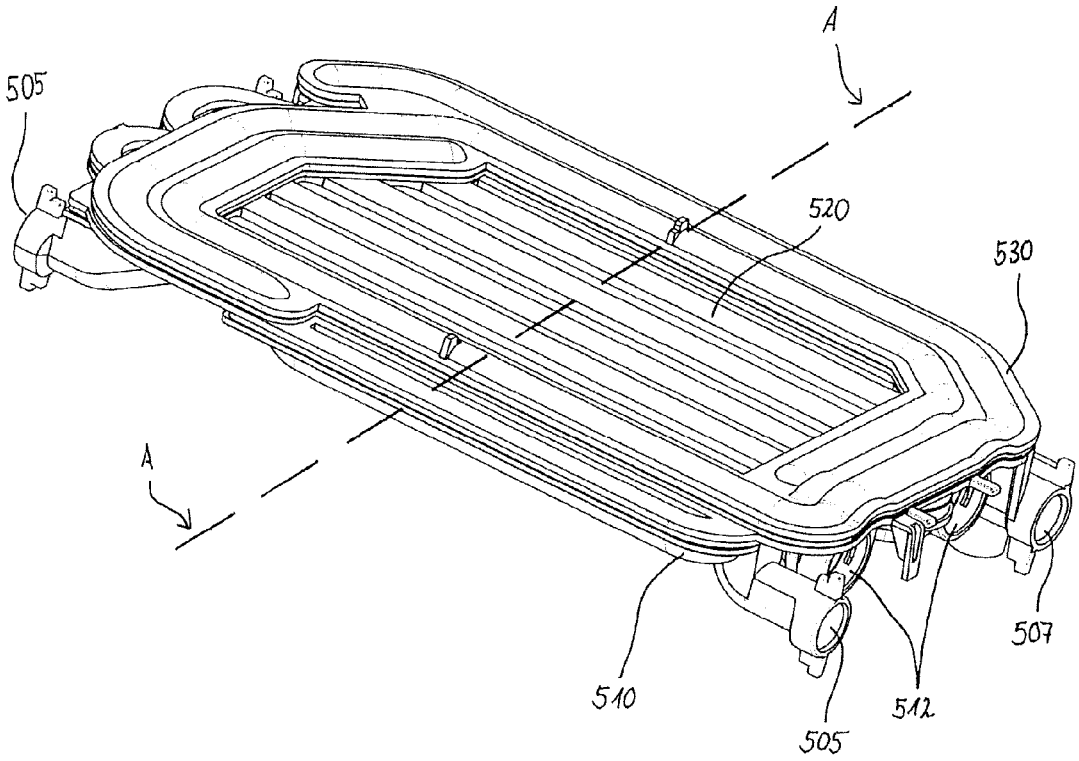

FIG. 6 shows, in a perspective view, an exemplary embodiment of three partial shells connected to one another.

Figure 6A:
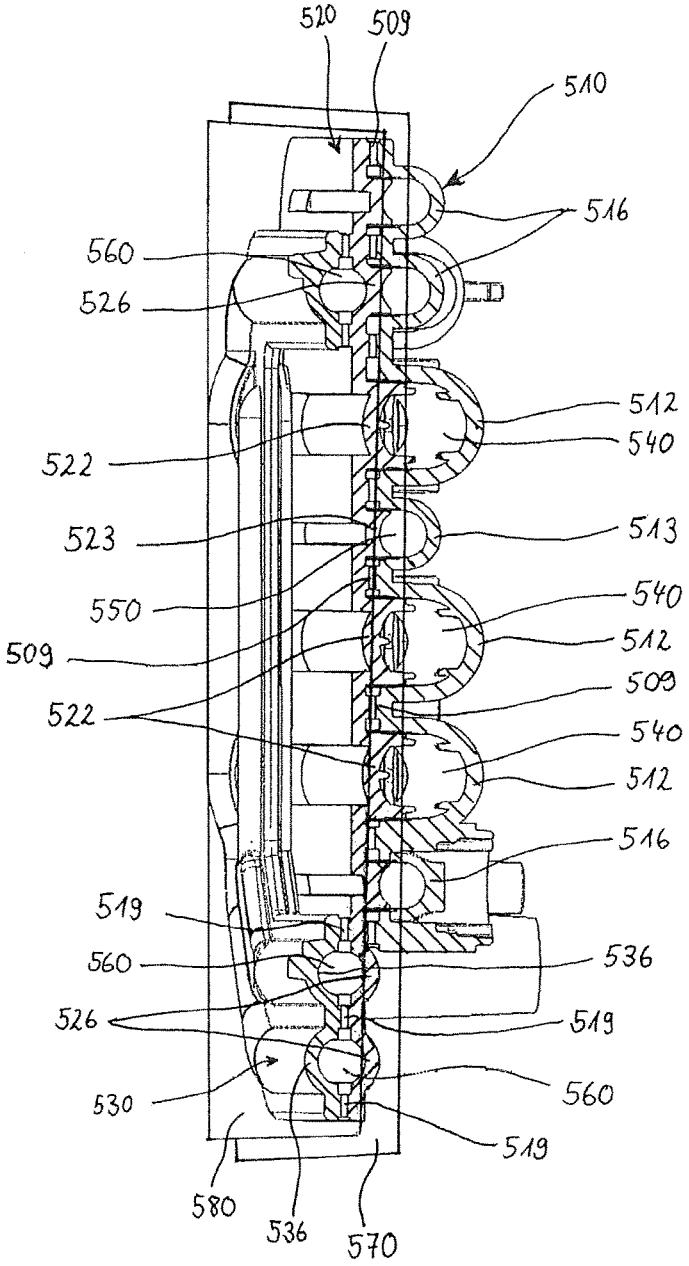

FIG. 6*a* shows the three partial shells connected to one another, from FIG. 6, in a sectional view.

The figures contain, in part, simplified schematic illustrations. In part, identical reference signs are used for similar but possibly not identical elements. Different views of the same elements may be to different scales.

FIG. 1 shows a first partial shell 1 in a plan view of the outer side. The first partial shell 1 has a heating duct half 13 which comprises three heating sections in the form of first grooves or channels 2 and an intermediate duct section 3. The three heating sections are connected to one another via diversion points 4 and are designed for accommodating a heating element and for conducting water. The intermediate duct section 3 is intended not to accommodate a heating element and is used as an electrical insulation path between the two heating sections. The first grooves or channels 2 are in each case arranged parallel to one another and run in meandering form together. The intermediate duct section 3 is arranged between two of the first grooves or channels 2. The intermediate duct section 3 has a smaller duct diameter than the first grooves or channels 2 and is, at its ends, connected via in each case one diversion point 4 to in each case one first groove or channel 2. After being placed together with a further partial shell which corresponds to the first partial shell 1, the heating duct half 13 forms, together with a heating duct half formed in said further partial shell, a heating duct into which there are inserted heating elements, in particular heating wires in the form of a heating coil.

The first grooves or channels 2 have, at one end, preferably circular recesses 11 for electrical terminals for the contacting of a respective heating coil in the respective heating section 2. Furthermore, it is possible in FIG. 1 to see openings 12 for the connection of a temperature sensor or the like. In this case, a thermostat of said type is used, preferably in the manner of a temperature limiter, to monitor a fixed or preset temperature.

The first partial shell 1 has two insulation duct sections 6 which are arranged parallel to the first grooves or channels 2. The insulation duct sections 6, the heating duct section 2 and the intermediate duct section 3 are arranged in a first duct plane of extent.

The insulation duct sections 6 have in each case one opening 8 through which the insulation duct sections 6 are led into a further, second duct plane of extent or into a further partial shell. On one of the two insulation duct sections 6, in each case one outlet point 5 is arranged at the respective end. The water that is heated in the heating block is discharged through the outlet point 5. Owing to the fact that the first partial shell 1 has two outlet points 5, the first partial shell 1 is suitable for use in an under-table arrangement or in an over-table arrangement. The outlet points 5 can be selectively opened or closed.

FIG. 1*a* shows the inner side of the first partial shell 1 from FIG. 1. The first partial shell 1 has, on its inner side, a joining surface 9 which is designed for being welded to a further partial shell. The joining surface 9 is arranged on the outer edge of the first partial shell 1 and between the individual duct sections. The joining surface 9 as a whole is thus of labyrinthine form. It can also be seen that the first grooves or channels 2 have a larger duct diameter than the diversion points 4. The diversion points 4 have approximately the same duct diameter as the first duct section of the intermediate duct 3. In the transition region, the duct diameter of the first grooves or channels 2 is narrowed to the duct diameter of the diversion points 4.

FIGS. 1*b* to 1*e* each show the first partial shell 1 in various side views. It can be seen here that the outlet points 5 are arranged in a different plane than the duct sections. From the insulation duct sections 6, a ramp 10 leads out of a first duct plane of extent 70 to the outlet point 5, at which the water flows out. The insulation duct sections 6 and the diversion points 4 have a smaller duct diameter than the first grooves or channels 2. In other embodiments, the diameters of the diversion points are not smaller. In particular, by means of a proposed welding process which does not involve friction welding, it is possible to dispense with diversion points of reduced diameter.

Also shown in FIGS. 1*b* to 1*e* is a joining plane 90. In the joining plane 90, the first partial shell 1 is joined together with a corresponding partial shell by way of the joining surface 9. FIGS. 1*d* and 1*e* show that the joining surface 9 has three sections 9*a*, 9*b* and 9*c* which are arranged in the joining plane 90 and two sections 9*d* and 9*e* which are arranged outside the joining plane 90. The sections 9*d*, 9*c* outside the joining plane 90 are arranged below the openings 12 for the connection of a temperature sensor or the like. Thus, the partial shell 1 is adapted to the opening 12. The opening 12 thus has a constant wall thickness. At this location, there are no material accumulations or instances of the minimum wall thickness being undershot, because the joining surface 9 does not need to be situated in the joining plane 90.

FIG. 2 shows a second partial shell 100 in a plan view. The second partial shell 100 has insulation duct sections 106 which have straight sections 116 and approximately right-angled sections 117. The insulation duct sections 106 begin or open out at an opening 108 which forms a connection to a further partial shell. Also shown is a joining surface 119 for welding to a further partial shell. In this case, the joining surface 119 is arranged around the insulation duct sections 106 and is approximately of labyrinthine form. After the second partial shell 100 is joined to a further partial shell, the insulation duct sections 106 together with corresponding duct sections in the further partial shell form the insulation duct.

FIG. 2 shows two inlet points 107 into which cold water can flow. By way of the two inlet points 107, the partial shell 100 is designed for use in an over-table and an under-table arrangement. For this purpose, one of the two inlet points 107 is selected for use, and the other is or remains closed off.

FIG. 2*a* shows the second partial shell 100 from FIG. 2 from the other side. It is possible to see three second grooves or channels 102 which are arranged parallel to one another and which are connected to one another via diversion points 104. Between two of the second grooves or channels 102 there is arranged an intermediate duct section 103 which is connected at each of its ends to a second groove or channel 102 via diversion points 104. It is also possible to see two insulation duct sections 106 which are arranged parallel to the second grooves or channels 102. The insulation duct sections 106 each have openings 108 by means of which the insulation duct sections 106 are connected to a further partial shell or to further duct sections in a further duct plane of extent. Also shown is a joining surface 109 which is arranged around the individual duct sections and is approximately of labyrinthine form. The second partial shell 100 thus has in each case one joining surface 109, 119 on both sides. It is thus designed for being connected to two further partial shells.

FIGS. 2*b* to 2*e* show the second partial shell 100 from FIG. 2 in various side views. A ramp 110 is shown which is formed for example by hot-gas welding to a connection piece preferably from the first partial shell.

Also shown in FIGS. 2*b* to 2*e* is a joining plane 190. In the joining plane 190, the second partial shell 100 is joined together with a corresponding partial shell, in particular with the partial shell from FIG. 1, by way of the joining surface 109.

Also shown is a further joining plane 191. A joining surface 109 or 119 is arranged, in sections, in the joining plane 190 or 191 respectively. In two sections, the joining surfaces 109 and 119 each have a mutually corresponding domed formation 120. Owing to the domed formation 120, the joining surface 109 or 119 is not arranged in the respective joining plane 190 or 191 at these locations.

FIG. 3 shows a third partial shell 200 in a perspective view. In this case, the third partial shell 200 has two insulation duct sections 206 which are formed partly as straight sections 216 and as sections 217 arranged approximately at right angles thereto. The duct sections are additionally formed in that, instead of being diverted through 180°, they are diverted twice through 90°, specifically in the diversion sections 215, which may also exhibit stepped diversions, for example two times approximately 45°. Around the insulation duct sections 206 there is arranged a joining surface 219 for welding to a further partial shell. The joining surface 219 is formed partly in a joining plane 291 and partly outside the joining plane 291. In this case, the joining surface 219 has, in four regions, a respective domed formation 220 which projects in each case out of the joining plane 291. The domed formations 220 correspond to the domed formations 120 of the second partial shell, which are connected to those of the third partial shell 200.

FIGS. 3*a* and 3*b* show the partial shell 200 from FIG. 3 in a plan view from above and from below.

FIGS. 3*c* to 3*f* show the third partial shell 200 from FIG. 3 in various side views. In these figures, the joining surface 219 can be seen. FIG. 3*d* shows that the joining surface 219 is situated outside the joining plane 291 in the region of the domed formations 220. Furthermore, between the domed formations 220, a section 221 is shown which is arranged parallel to the joining plane 291 and in this case outside the latter.

FIG. 4 shows a continuous-flow heater 600, without a cover, in a plan view. The continuous-flow heater 600 has a housing 315 in which there are arranged a first partial shell 310 and a second partial shell 320, which are part of a heating block 300. The first partial shell 310 and the second partial shell 320 are connected to one another. It is possible to see three first grooves or channels 302, which run parallel to one another and which are connected to one another in each case via a diversion point 304, of the first partial shell 310. Also shown are the insulation duct sections 306. The inlet points 307 and the outlet points 305 are connected to water ports 325 for the admission and discharge of water respectively. The water ports 325 are arranged outside the housing 315. By virtue of the fact that the continuous-flow heater 600 has four such water ports 325, it can be used for an under-table and over-table arrangement.

FIGS. 4*a* and 4*b* show the continuous-flow heater 600 from FIG. 4 in various side views.

FIG. 5 shows a duct system 400 of a heating block, for example of the heating block 300 in FIG. 4. The arrows indicate the flow direction of the water. Cold water is firstly introduced into the system at an inlet point 407. The water flows firstly through the insulation duct 406 through a straight duct section 416 in a first duct plane of extent 470. At the end of said straight duct section 416, the duct leads, in a transition region 418, from the first duct plane of extent 470 into a second duct plane of extent 480. There, the water flows through two transversely oriented duct sections 427 and through a longitudinally oriented duct section 426. In between, diversion sections 425 serve to generate in each case approximately right-angled diversions. Said duct sections can be regarded as an inlet-side insulation duct, which now ends approximately at a transition back into the first duct plane of extent 470. This is followed by the heating duct with the heating duct sections 402 and the intermediate duct section 403, which are all arranged in the first duct plane of extent 470. The water subsequently passes into an outlet-side insulation duct which is again arranged substantially in the second duct plane of extent 480. There, it comprises substantially two longitudinally oriented duct sections 426 and two transversely oriented duct sections 427. The following duct section in the second duct plane of extent 480 runs, in an approximately right-angled duct section 427, to a further straight duct section 426. After a further approximately right-angled duct section 427 and a further straight duct section 426, the duct section leads, in a further transition region 428, back into the first duct plane of extent 470. Here, the water flows in meandering form through the heating duct 402 and the intermediate duct 403. Thereafter, the duct leads, via a further transition region 419, back into the second duct plane of extent 480. The next duct section runs initially via a straight duct section 426 via three duct sections 427 arranged approximately at right angles to one another. Said outlet-side insulation duct basically extends as far as the outlet point 405, which is arranged in neither of the two duct planes of extent. Alternatively, the water may flow in through an inlet point 407' and out through an outlet point 405', which are both shown at the top in the illustration of FIG. 5.

It can be seen from FIG. 5 that the heating ducts 402 which run in meandering form and the intermediate duct 403 are arranged in the first duct plane of extent 470, and the insulation ducts 406, which run straight and approximately at right angles to one another, are arranged substantially in the second duct plane of extent 480.

FIG. 5*a* shows the duct system from FIG. 5 in a side view. Said figure shows the first duct plane of extent 470 and a second duct plane of extent 480.

FIG. 6, in a perspective view, shows three partial shells connected to one another—specifically a first, second and third partial shell 510, 520 and 530, such as for example the first partial shell from FIG. 1, the second partial shell from FIG. 2 and the third partial shell from FIG. 3. The second partial shell 520 is arranged between the first partial shell 510 and the third partial shell 530 and is fixedly connected to each of these. Also shown are two openings 512 for the connection of a thermostat or the like.

FIG. 6*a* shows a section A-A of the three connected partial shells from FIG. 6. Here, the first partial shell 510, the second partial shell 520 and the third partial shell 530 can be seen. The first partial shell 510 has three first grooves or channels 512, an intermediate duct half 513 arranged between two of the first grooves or channels 512, and three insulation duct halves 516. The second partial shell 520 has second grooves or channels 522 corresponding thereto, a second intermediate duct half 523, and second insulation duct halves 526. The first grooves or channels 512, the intermediate duct half 513 and the insulation duct halves 516 each have a greater depth than the grooves or channels 522 corresponding thereto, intermediate duct halves 523 and insulation duct halves 523 in the second partial shell 520. The second grooves or channels 522 placed together with the first grooves or channels 512 together form the heating duct 540, the intermediate duct halves 513 and 523 form an intermediate duct 550, and the insulation duct halves 516 and 526 form an insulation duct 560. The ducts are all situated in a first duct plane of extent 570. All of the ducts in the first duct plane of extent 570 are formed by the connection of the first partial shell 510 and of the second partial shell 520. The connection is formed by way of the joining surfaces 509, preferably by means of welding. The third partial shell 530 is not connected to the first partial shell 510.

In a second duct plane of extent 580, it is possible to see three further insulation ducts 560. The insulation ducts 560 are formed from the connected second partial shell 520 and third partial shell 530. The second partial shell 520 has three insulation duct halves 526 facing toward the third partial shell 530. The third partial shell 530 has three insulation duct halves 536 corresponding thereto, said insulation duct halves together forming the insulation ducts 560. The insulation ducts 560 are arranged in the second duct plane of extent 580. The second partial shell 520 and the third partial shell 530 are connected to one another, preferably by means of welding, at the joining surfaces 519.

The invention claimed is:

1. A heating block for use in a calorifier for heating water, comprising a heating block body, composed in particular of plastic, for forming a cavity for conducting the water and for accommodating at least one heating element, wherein the heating block body comprises:

a first partial shell with a first sub-cavity and a second partial shell with a second sub-cavity, wherein the first and the second partial shell are placed together in a joining region and form between them the cavity composed of the two sub-cavities, and the joining region is at least partially not formed in a joining plane, and/or the first and the second partial shell are welded to one another by means of a medium through the supply of heat, in particular are welded by means of a substantially abrasion-free and/or vibration-free welding process, and/or the first sub-cavity has a greater depth than the second sub-cavity or vice versa, wherein a third partial shell is provided which is placed together with the first or second partial shell such that the first or second and the third partial shell form between them an insulation duct for forming an insulation path, wherein the insulation duct is in particular free from heating elements.

2. The heating block as claimed in claim 1, wherein the first and the second partial shell are each formed as plastics injection-molded parts.

3. The heating block as claimed in claim 1, wherein the cavity forms a heating duct for accommodating at least one heating element and the heating duct is arranged between the first and the second partial shell in a first duct plane of extent, and the insulation duct is arranged between the second and the third partial shell in a second duct plane of extent, in particular such that the first, second and third partial shells form a sandwich structure.

4. The heating block as claimed in claim 1, wherein the heating duct has meandering duct sections, and/or the insulation duct has straight duct sections, which are connected to one another approximately at right angles.

5. The heating block as claimed in claim 1, wherein the first and the second partial shell and optionally a or the third partial shell are placed together and fixedly connected by means of hot-gas welding.

6. The heating block as claimed in claim 5, wherein at least one insulation duct has an inlet point for the supply of the medium and at least one insulation duct has an outlet point for the discharge of the medium, and/or the inlet point and outlet point are/is fixedly connected to one of the partial shells.

7. The heating block as claimed in claim 1, wherein the at least one heating element has a component through which electrical current flows, in particular a heating coil.

8. The heating block as claimed in claim 1, wherein the meandering heating duct has a wall thickness which is uniform substantially throughout, in particular has a wall thickness which is uniform throughout in the circumferential direction of the heating duct.

9. The calorifier for heating a liquid medium, comprising a heating block as claimed in claim 1.

10. The calorifier as claimed in claim 9, wherein the calorifier has a casing, in particular a housing, comprising a rear wall, a front wall, a first and a second side wall, a cover and a base, wherein one partial shell, in particular the third partial shell, of the heating block is formed as a constituent part of the rear wall.

11. The calorifier as claimed in claim 9, wherein the calorifier is designed for use in an over-table arrangement and/or under-table arrangement.

12. The partial shell designed for use for producing a heating block as claimed in claim 1, comprising a joining surface designed for welding to a further joining surface of a further partial shell, wherein the joining surface is at least partially not arranged in a joining plane.

13. The partial shell designed for use for producing a heating block as claimed in claim 1, comprising two water ports, wherein one water port forms a water inlet point and one water port forms a water outlet point, wherein at least one water port is situated at least outside one of the joining planes and is formed out of one of the partial shells, and wherein, in particular, the water inlet point and/or the water outlet point defines a flow direction which is substantially parallel to the joining plane.

14. A heating block for use in a calorifier for heating water, comprising a heating block body, composed in particular of plastic, for forming a cavity for conducting the water and for accommodating at least one heating element, wherein the heating block body comprises:

a first partial shell with a first sub-cavity and a second partial shell with a second sub-cavity, wherein the first and the second partial shell are placed together in a joining region and form between them the cavity composed of the two sub-cavities, and the joining region is at least partially not formed in a joining plane, and/or the first and the second partial shell are welded to one another by means of a medium through the supply of heat, in particular are welded by means of a substantially abrasion-free and/or vibration-free welding process, and/or the first sub-cavity has a greater depth than the second sub-cavity or vice versa, wherein the cavity has at least one meandering heating duct, wherein the heating duct has at least one heating section with the heating element for heating the water, and wherein, in the first and the second partial shell, in each case one first and second duct half of the heating duct is in the form of a first and second meandering channel or groove respectively, and the first meandering groove or channel has a greater depth than the second meandering groove or channel or vice versa, wherein the meandering heating duct has heating sections with opposite flow directions arranged parallel to one another, and between the heating sections arranged parallel to one another, there is arranged at least one intermediate duct for separating the potentials, wherein the at least one intermediate duct is connected to a heating section at a diversion point, and the intermediate duct in particular does not have a heating element.

15. The heating block as claimed in claim 14, wherein the heating duct has a larger duct circumference in straight sections than in one or all of the diversion points and/or in the intermediate duct.

16. The heating block as claimed in claim 1, wherein the heating block has water ports for use in the case of over-table and under-table arrangements.

* * * * *